United States Patent [19]

Koski et al.

[11] 4,183,148

[45] Jan. 15, 1980

[54] PAPER MACHINE DRYING SECTION AND METHOD OF OPERATING THE SAME

[75] Inventors: Erkki Koski; Martti Koponen, both of Jyvaskyla, Finland

[73] Assignee: Valmet Oy, Finland

[21] Appl. No.: 812,043

[22] Filed: Jul. 1, 1977

[30] Foreign Application Priority Data

Jul. 5, 1976 [FI] Finland ..... 761953

[51] Int. Cl.[2] ..... F26B 3/00

[52] U.S. Cl. ..... 34/23; 34/52; 34/116; 34/121; 34/123

[58] Field of Search ..... 34/23, 116, 121, 123, 34/52, 159, 161; 162/207, 290

[56] References Cited

U.S. PATENT DOCUMENTS

| | | | |
|---|---|---|---|
| 3,378,936 | 4/1968 | Buss | 34/116 |
| 3,643,338 | 2/1972 | Fair | 34/116 X |
| 4,000,035 | 12/1976 | Schiel et al. | 34/116 X |

*Primary Examiner*—Benjamin R. Padgett
*Assistant Examiner*—E. Suzanne Parr
*Attorney, Agent, or Firm*—Steinberg & Blake

[57] ABSTRACT

A paper machine drying section has a pair of staggered rows of rotary dryer cylinders which include a first group of cylinders of both rows which form an initial part of the drying section where a web is initially received from a press section. A first endless fabric which forms a closed loop is guided around the above group of cylinders in a manner situating the cylinders of one of the rows within the loop to form inside cylinders therefrom and the cylinders of the other of the rows outside of the loop to form outside cylinders therefrom, this first endless fabric transporting a web which is to be dried around the cylinders of the above group while situating the web between the first endless fabric and the outside cylinders and the first endless fabric itself between the inside cylinders and the web. A second endless fabric structure is pressed against the web only at the portions thereof which lap the inside cylinders for preventing the web from being displaced by centrifugal force outwardly away from the inside cylinders, a suitable speed-control being connected with the second endless fabric structure to provide for the latter a speed of travel according to which the portions of the second endless fabric structure which lap the inside cylinders have an angular velocity substantially equal to the angular velocity of the inside cylinders.

15 Claims, 1 Drawing Figure

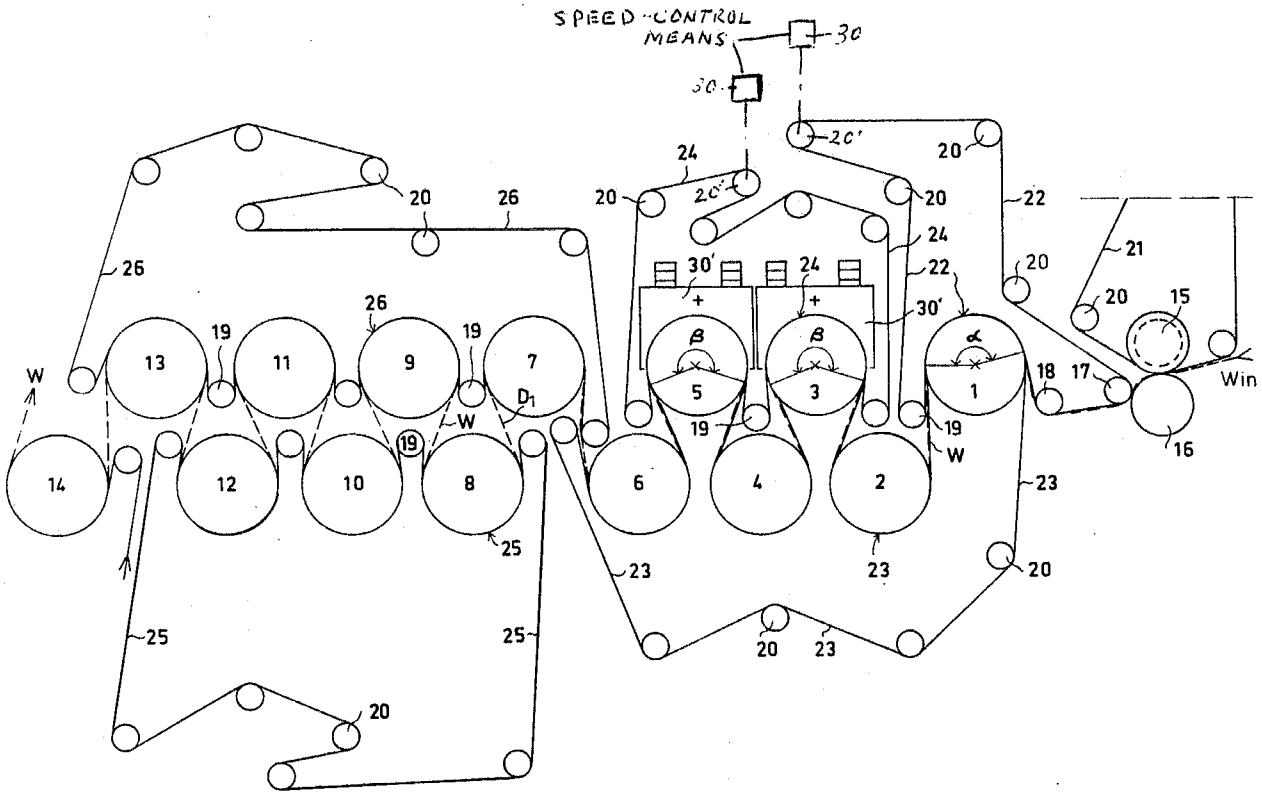
SPEED CONTROL MEANS
Win
W

PAPER MACHINE DRYING SECTION AND METHOD OF OPERATING THE SAME

BACKGROUND OF THE INVENTION

The present invention relates to paper machines and methods for operating the same.

In particular, the present invention relates to the initial part of the drying section of a paper machine where a web undergoes an initial drying action upon being transported away from the press section of the paper machine.

The drying section of the paper machine is in the form of a multiple cylinder dryer having a pair of staggered rows of drying cylinders which may be disposed one above the other. The first group of drying cylinders of these rows where the web is initially received in the drying section serves to guide a first endless fabric, in the form of a suitable wire or felt, with the cylinders of one row being situated within the closed loop of this first endless fabric while the cylinders of the other row are situated outside of the loop to form outside cylinders. At the inside cylinders the endless fabric is situated between the latter cylinders and the web, and it is at this location that the particular problems are encountered as set forth below. With respect to the outside cylinders, the web is situated between the latter and the above first endless fabric. The web is to be understood as being a full-width paper web, which is to say a web having a width almost equal to that of the cylinders of the drying section.

As the operating speeds and operating widths of paper machines increase, a serious problem is encountered in connection with web breaks which occur at the initial part of the drying section. As a result of this problem, certain multiple cylinder dryer constructions have been proposed in the prior art wherein the so-called closed conduction has been implemented. In other words the constructions are such that the web is conveyed without any open draw.

With respect to the state of the prior art pertinent to the present invention, reference may be made to U.S. Pat. Nos. 2,874,997, 2,091,905, 3,503,139, and 3,576,078, as well as to the German Offenlegungsschrift No. DOS 2,365,458.

In U.S. Pat. No. 2,874,997 there is a multiple cylinder dryer having a closed web conduction, or in other words web transporting without an open draw, with both contact drying and perfusion drying being combined by arranging the cylinders of one row of the multiple cylinder dryer in such a way as to be cylinders which admit a drying gas flow through the walls thereof, while arranging adjacent to the latter cylinders special hoods from which a drying gas flow is conducted through the web, the supporting wire, and the foraminous cylinder shells.

A similar construction is disclosed in the above German publication No. DOS 2,365,438. In this latter disclosure there has been provided a narrow web-introduction strip or tail which is situated on the web which passes over the upper row of the drying cylinder group, with this strip or tail being moved by way of a special structure from the marginal area of the cylinders so as to be on top of the web.

U.S. Pat. No. 2,091,805 shows a multiple cylinder dryer wherein there is also a closed web conduction so that there are no free or open draws of the web. According to this patent also, in those embodiments where the web passes from one cylinder row to the other in zig-zag fashion, supported by a wire, one of the rows of drying cylinders consists of suction cylinders having a permeable shell through which a fluid such as air can flow.

With respect to U.S. Pat. No. 3,503,139, there is also disclosed a multiple cylinder dryer wherein the web passes from one row of the cylinder group to the other while supported by a wire. In this connection the temperature of the cylinders of the upper row has been provided at a value higher than usual because on these particular cylinders the wire or felt is interposed between the web and the surface of the drying cylinders.

U.S. Pat. No. 3,576,078 discloses a multiple cylinder dryer having a pair of wires utilized for directing the web through the entire drying cylinder group. With respect to the drying section of this reference, this particular drying section has perfusion cylinders. However, the web is compelled to travel both at the upper as well as the lower cylinders between two wires at all times, so that there is the serious drawback that at the points where the path of the wires is curved there are necessarily speed differentials between the wires and the web, causing unavoidable friction with the web and giving rise in turn to detrimental dust formation as well as to impairment of the quality of the web surface.

Thus, with the exception of this last-mentioned U.S. patent, where a pair of wires are used throughout, it is essential with the other prior art constructions to utilize in at least one of the cylinder rows drying cylinders which have permeable shells and in connection with which there are provided suction and/or over-pressure chambers.

The fact is that cylinders having foraminous and thus permeable shells, as well as the suction or pressure equipment associated therewith, are comparatively expensive.

It is to be noted that perfusion cylinders are designed not so much for drying purposes. Their main purpose is to eliminate the effects of centrifugal force and the detachment and excessive distention of the web resulting therefrom when the web curves on the surface of the drying cylinders without any other support.

SUMMARY OF THE INVENTION

It is accordingly a primary object of the present invention to provide a method and apparatus which will avoid the above drawbacks.

In particular, it is an object of the present invention to provide a method and apparatus according to which it is possible to subject a web at least in the initial part of the drying section to a drying action while providing for the web a closed conduction, which is to say transportation without any open draw, and while at the same time avoiding the necessity of utilizing perfusion cylinders.

Thus, it is an object of the present invention to provide for transportation of the web through the initial part of the drying section without any open web draw while assuring that the web will remain properly in engagement with the drying cylinders, or in other words assuring that the web will not be displaced away from the drying cylinders by centrifugal force, while at the same time avoiding any possibility of relative friction between the web and the fabric or wire in engagement therewith, and of course also while avoiding the use of perfusion cylinders.

In order to achieve the above objects the invention is primarily characterized in that in order to maintain the web properly at the surface of the drying cylinders, particularly at that row of cylinders which are situated within the loop of a first wire or felt, there is provided at this location upon the web one or more additional wires or felts having substantially the same width as the web and preferably having a relatively wide mesh, these additional wires or felts pressing against the web at the most at that sector thereof which laps the particular cylinders, and in order to prevent any friction between the additional wires or felts and the web, as well as to avoid undesirable raising of dust from the web, the angular velocity of the additional wires or felts with respect to the centers of the drying cylinders lapped thereby has been automatically controlled so as to be substantially equal. In other words the angular velocity of the additional wires or felts where they lap the cylinders is the same as that of the particular cylinders.

Thus, in accordance with the present invention there is provided a method and apparatus for operating a paper machine drying section which includes a pair of staggered rows of rotary dryer cylinders a first group of both rows of which form an initial part of the drying section where a web is initially received from a press section so as to undergo an initial drying action. A first endless fabric means, in the form of a suitable felt or wire, forms a closed loop and is guided around the cylinders of the first group in such a way that the cylinders of one of the rows form inside cylinders situated within the loop and the cylinders of the other of the rows form outside cylinders situated outside of the loop, the web which is to be dried being transported along these cylinders of the first group by the first endless fabric means in such a way that the web is situated between the outside cylinders and the first endless fabric means while the first endless fabric means is situated between the inside cylinders and the web. According to the present invention a second endless fabric means, which has a width substantially equal to that of the web, is pressed against the web only at the portions of the latter which lap the inside cylinders, so as to prevent in this way the web from being displaced by centrifugal force outwardly away from these inside cylinders. In addition there is provided for this second endless fabric means, which takes the form of one or more suitable felts or wires, a speed of travel according to which the portions of the second endless fabric means which lap the inside cylinders have an angular velocity substantially equal to the angular velocity of the inside cylinders, so that in this way it is possible to avoid friction between the second endless fabric means and the web as well as to avoid raising of dust from the second endless fabric means.

BRIEF DESCRIPTION OF DRAWING

The invention is illustrated by way of example in the accompanying drawing which forms part of this application and in which one possible embodiment of the method and apparatus of the invention is schematically illustrated, the drawing illustrating a drying section and part of the adjoining press section of a paper machine. This structure is schematically illustrated in the drawing in elevation, and the method and apparatus of the present invention are particularly illustrated at the initial part of the drying section of the paper machine, where the web is initially received from the press section to undergo an initial drying action.

DESCRIPTION OF PREFERRED EMBODIMENTS

Referring now to the drawing, the illustrated drying section of a paper machine includes the rotary dryer cylinders 1–14 which in a known way are capable of being heated by steam and which are arranged in a pair of rows in which the cylinders are staggered in such a way that the axes of the cylinders of the upper row are situated in alignment with the spaces between the cylinders of the lower row. Of the above rotary dryer cylinders, the cylinders 1–6 form a first group which is situated at that part of the drying section which initially receives the web from the press section so that the web undergoes an initial drying action at the first group of cylinders 1–6. The method and apparatus of the present invention are primarily located at this first group of cylinders. The subsequent cylinder group 7–14 is conventional and includes an upper felt 26 as well as a lower felt 25, these felts being guided by the guide rolls 20 as well as by the guide rolls 19. It will be seen that the guide rolls 19 are situated in the spaces between the cylinders in a well known manner. A further felt is fragmentarily illustrated at the last dryer cylinder 14 for conducting the web W, which has been schematically illustrated, away from the drying section.

Part of a press section is shown at the right of the drawing where the web W is designated Win inasmuch as it is shown where it enters the last nip of the press section, this last nip being defined between the press rolls 15 and 16. At this last nip the upper press roll 15 is situated within the loop of an endless felt 21 guided also by guide rolls 20 in the manner illustrated.

A pickup roll 17 is situated next to the last press roll 16, and this pickup roll 17 is situated in close proximity to the press roll 16 and may be urged toward the latter in some cases. An endless felt 22 travels with the web through the nip between the pickup roll 17 and the last press roll 16, with the web W travelling from the pickup roll 17 together with the felt 22 so that the latter serves to support and carry the web, without any open draw of the latter, away from the pickup roll 17 toward the drying section. The web of course engages the lower surface of the felt 22 as the latter travels from the roll 17 to the suction roll 18. At the rotary suction roll 18 the web W and the endless felt 22 change their direction in such a way that they travel together upwardly toward the end cylinder 1, which forms the first cylinder of the drying section to receive the web from the press section. Thus, the suction roll 18 is situated adjacent the drying section to deliver the web and felt 22 to the drying section in the manner illustrated.

The dryer cylinder group 1–6 cooperates with a special felt or wire 23, forming an endless fabric means which provides a closed loop as illustrated. This endless fabric means 23 passes around the cylinders 1–6 in such a way that the cylinders 1, 3, 5 of the upper row are situated within the loop of the endless fabric means 23 to form inside cylinders with respect thereto, while the cylinders 2, 4, 6 at the lower row are situated outside of this loop and thus form outside cylinders with respect to the endless fabric means 23. Thus, by way of this arrangement it is possible for the web W to be transported in closed conduction, which is to say without any open draw, through the initial part of the drying section from one to the other row of cylinders of the first group 1–6, the web thus being supported by the felt or wire at all times while lapping the cylinders 1–6. While the web W, which is illustrated in dotted lines, is shown in the drawing as separating slightly from the endless fabric means 23 as the latter travels beyond the roll 6, so that there is a slight open draw in the path of web travel from the cylinder 6 to the cylinder 7, the first open draw $D_1$ of any significance occurs between the cylinders 7 and 8 of the second group, as illustrated. Thus, free or open web draws are completely avoided at the first group of cylinders 1–6.

As is shown in the drawing, the first endless felt or wire 22 which transports the web to the drying section laps the end inside cylinder 1 through a considerable sector $\alpha$, and at this sector the web W is interposed between the endless wires or felts 22 and 23. In the example illustrated there is provided at the additional cylinders 3 and 5 of the upper row, or in other words at the additional inside cylinders, a further endless wire or felt 24 of relatively wide mesh. Thus, the endless wires or felts 22 and 24 form a second endless fabric means cooperating with the first endless fabric means 23 for transporting the web through the first group of cylinders 1–6. Furthermore it will be noted that the guide rolls 19 are situated at the spaces between the cylinders 1, 3, and 5 for guiding the felts or wires 22 and 24 in the manner illustrated so that they travel around and lap only the inside cylinders 1, 3, 5 in the manner illustrated. This endless wire or felt 24 is preferably of a relatively wide mesh so that the surrounding atmosphere will have free access to the web through the endless wire or felt 24. Thus at the inside cylinders 3 and 5, it is the endless wire or felt 24 which presses against the web with the latter being situated between the endless wire or felt 23 and the endless felt 24 at the locations where the web laps the cylinders 3 and 5.

It is to be noted that while the web W laps the cylinder 1 through the illustrated angle $\alpha$, which is a substantial angle almost equalling 180°, the web laps the cylinders 3 and 5 through an even greater angle $\beta$, and in all cases the endless wires or felts 22 and 24 press against the web where it laps the inside cylinders 1, 3, 5 only at portions of the web which lap these cylinders 1, 3, 5 so that the endless wires or felts 22 and 24 do not lap the inside cylinders 1, 3, 5 in any case through an angle greater than the web itself. Of course the endless fabric means 23 also laps the inside cylinders 1, 3, 5 through the same angles as the web, so that the endless fabric means 22, 24 also does not lap the inside cylinders through an angle greater than that of the endless fabric means 23.

While the guide rolls 19 which guide the endless fabric means 22, 24 are situated at the spaces between the cylinders 1, 3, 5, as illustrated, outwardly beyond the cylinders both the endless fabric means 23 and the endless fabric means 22, 24 are guided by the guide rolls 20 in the manner illustrated. The endless fabric means are driven in any known way, and in the example illustrated the endless wires or felts 22 and 24 may be driven by way of driving guide rolls 20' which are schematically illustrated as being operatively connected with speed control units 30. These units 30 form a speed-control means which in a known way can be regulated for automatically providing for the felts or wires 22 and 24 at the portions thereof which lap the cylinders 1, 3, 5 an angular velocity equal to the angular velocity of these cylinders, so that in this way it is possible automatically to prevent any friction between the wires or felts 22 and 24 and the web at the location where the latter laps the cylinders 1, 3, 5. Thus, the angular velocity of the endless fabric means 22, 24 where it laps the cylinders 1, 3,5 is automatically maintained at the same value as the angular velocity of the cylinders 1, 3, 5.

The purpose of the wide-mesh wire or felt 24 is to maintain the web pressed inwardly toward the cylinders 3 and 5 so as to prevent detachment of the web where it laps the cylinders 3 and 5 as a result of the influence of centrifugal force, this action also preventing excessive stretching of the web. Of course, the same result is achieved by way of the felt or wire 22 at the location where the web laps the end inside cylinder 1. Furthermore, by way of the wide-mesh wire or felt 24 it is possible to maintain a good surface quality for the web.

As a result of the above feature of maintaining the angular velocity of the endless fabric means 22, 24 equal to that of the cylinders 1, 3, 5 where these cylinders are lapped by the endless fabric means 22, 24, by way of the automatic controls received from the speed-control means 30, undesirable frictional rubbing between the web and the felts or wires 22 and 24 is avoided and in this way there will be no raising of any dust in an undesirable manner from the web W.

The drawing also schematically illustrates a pair of over-pressure hoods 30', which extend around the cylinders 3 and 5 in the manner schematically illustrated and which serve the purpose of producing a drying effect by blowing hot gas through the wide mesh fabric 24 onto the surface of the paper web. Thus, these hoods 30' together with the supply of hot drying gas thereto at an elevated pressure serve to situate the cylinders 3 and 5 together with the parts of the felt or wire 24 lapping the same in an atmosphere which has a pressure greater than atmospheric pressure.

Of course, the invention is not to be confined to the embodiments referred to above inasmuch as the details thereof may vary within the inventive concept defined by the claims which follow below.

What is claimed is:

1. In a method of operating a paper machine drying section which includes a pair of staggered rows of rotary dryer cylinders which include a first group of cylinders of both rows which form an initial part of the drying section where a web is initially received from a press section to undergo an initial drying action, the steps of guiding around a sector of each of the cylinders in both rows of said first group a first endless fabric means which forms a closed loop, in a manner situating the cylinders of one of said rows of said first group within said loop to form inside cylinders therefrom and the cylinders of the other of said rows of said first group outside of said loop to form outside cylinders therefrom, while transporting a web which is to be dried along and around said cylinders of said first group by way of said first endless fabric means in a manner situating said web between said first endless fabric means and said outside cylinders in contact with the latter while situating said first endless fabric means between the inside cylinders and said web, said web being carried between cylinders in adjacent rows by said first endless fabric means, and pressing against said web only at portions thereof which lap said inside cylinders a second endless fabric means having a width substantially equal to that of said web for preventing said web from being displaced by centrifugal force outwardly away from said inside cylinders, and providing for said second endless fabric means a speed of travel according to which the portions of said second endless fabric means which lap said inside cylinders have an angular velocity substantially equal to the angular velocity of said inside cylinders, to avoid friction between said second endless fabric means and said web as well as to avoid raising of dust from said second endless fabric means.

2. In a method as recited in claim 1 and wherein said second endless fabric means has a relatively wide mesh.

3. In a method as recited in claim 1 and wherein an end inside cylinder is the first cylinder of the drying section to receive a web from the press section, and guiding said second endless fabric means in part around a pickup roll between the latter and a press roll of the press section for transporting, by way of said second endless fabric means, a web from the press section to said end cylinder without any open draw so that the web remains constantly in engagement with said second endless fabric means while travelling from the press section to said end cylinder of said drying section to be situated at said end cylinder between said first and second endless fabric means.

4. In a method as recited in claim 3 and wherein said second endless fabric means includes at least first and second endless fabrics, the first of which is situated in advance of the second in the direction of web travel, and said first fabric of said second endless fabric means forming a closed loop in which said pickup roll is situated.

5. In a method as recited in claim 1 and including the step of providing around at least one of said inside cylinders where the latter is lapped by said second endless fabric means an atmosphere having a pressure greater than atmospheric pressure.

6. In a method as recited in claim 1 and including the step of guiding said second endless fabric means along said inside cylinders by way of guide rolls situated in spaces between said inside cylinders.

7. In a method as recited in claim 6 and wherein said staggered rows of cylinders of the drying section form upper and lower rows of cylinders, and said upper row of cylinders including said inside cylinders.

8. In a method as recited in claim 1 and wherein an end inside cylinder is the first cylinder of the drying section to receive a web from the press section, said second endless fabric means including first and second endless fabrics the first of which is situated in advance of the second in the direction of the web travel, and said first endless fabric forming a pickup fabric which transports a web from the press section to the drying section, and said first endless fabric being guided around said end cylinder in a manner lapping the latter over a substantial sector.

9. In a paper machine combination having a press section and drying section following said press section, a pair of staggered rows of rotary dryer cylinders forming part of said drying section and including a first group of cylinders of both rows which form an initial part of the drying section where a web is initially received from said press section to undergo an initial drying action, first endless fabric means forming a closed loop and guided around a sector of each of the cylinders in both rows of said first group in a manner situating the cylinders of one of said rows of said first group within said loop to form inside cylinders therefrom and the cylinders of the other of said rows of said first group outside of said loop to form outside cylinders therefrom, said first endless fabric means transporting a web which is to be dried along and around said cylinders of said first group in a manner situating said web between said first endless fabric means and said outside cylinders in contact with the latter while situating said first endless fabric means between said inside cylinders and said web, said web being carried between cylinders in adjacent rolls by said first endless fabric means, and a second endless fabric means having a width substantially equal to that of said web and pressing against said web only at portions thereof which lap said inside cylinders for preventing said web from being displaced by centrifugal force outwardly away from said inside cylinders, and speed-control means operatively connected with said second endless fabric means for providing for the latter a speed of travel according to which the portions of said second endless fabric means which lap said inside cylinders have a angular velocity substantially equal to the angular velocity of said inside cylinders, to avoid friction between said second endless fabric means and said web as well as to avoid raising of dust from said eecond endless fabric means.

10. The combination of claim 9 and wherein said second endless fabric means has a relatively wide mesh.

11. The combination of claim 9 and wherein an end inside cylinder is the first cylinder of said drying section to receive a web from the press section, the latter including a press roll, and a pickup roll being situated adjacent said press roll for defining a nip therewith, said second endless fabric means passing through the latter nip and around said pickup roll between the latter and said end inside cylinder for transporting a web from said press section to said end cylinder without any open draw, so that the web remains constantly in engagement with said second endless fabric means while travelling from the press section to said end cylinder of said drying section.

12. The combination of claim 11 and wherein said second endless fabric means includes at least first and second endless fabrics, the first of which is situated in advance of the second in the direction of web travel, and said first fabric of said second endless fabric means forming a closed loop in which said pickup roll is situated.

13. The combination of claim 9 and wherein a plurality of guide rolls are situated in spaces between said inside cylinders for guiding said second endless fabric means along said inside cylinders.

14. The combination of claim 9 and wherein said staggered rows of cylinders of the drying section form upper and lower rows of cylinders, and said upper row of cylinders including said inside cylinders.

15. The combination of claim 9 and wherein an end inside cylinder is the first cylinder of the drying section to receive a web from the press section, said second endless fabric means including first and second endless fabrics the first of which is situated in advance of the second in the direction of web travel, and said first endless fabric forming a pickup fabric for transporting a web from the press section to the drying section, said first endless fabric extending around said end cylinder over a substantial sector thereof.

* * * * *